United States Patent [19]

Johnson

[11] 4,082,072

[45] Apr. 4, 1978

[54] SEALING IN FUEL INJECTION PUMPS

[76] Inventor: Lloyd E. Johnson, 700 Highview Rd., East Peoria, Ill. 61611

[21] Appl. No.: 693,189

[22] Filed: Jun. 7, 1976

Related U.S. Application Data

[63] Continuation of Ser. No. 558,639, Mar. 17, 1975, abandoned.

[51] Int. Cl.[2] ..... F02M 59/02

[52] U.S. Cl. ..... 123/139 AA; 92/240; 123/139 R

[58] Field of Search .... 123/139 R, 139 AD, 139 BD, 123/139 AA; 92/240

[56] References Cited

U.S. PATENT DOCUMENTS

| | | | |
|---|---|---|---|
| 408,461 | 8/1889 | Capitaine | 123/139 R |
| 1,929,885 | 10/1933 | Gosslau | 123/139 AA |
| 2,044,814 | 6/1936 | Rothrock | 123/139 R X |
| 2,045,196 | 6/1936 | Mohr | 123/139 R |
| 2,746,443 | 5/1956 | Meyer | 123/139 BD |
| 2,849,997 | 9/1958 | Kravits | 123/139 R |
| 3,994,208 | 11/1976 | Boyer | 92/240 X |

FOREIGN PATENT DOCUMENTS

| | | | |
|---|---|---|---|
| 358,174 | 10/1931 | United Kingdom | 123/139 R |

*Primary Examiner*—Charles J. Myhre
*Assistant Examiner*—Tony M. Argenbright
*Attorney, Agent, or Firm*—Darbo & Vandenburgh

[57] ABSTRACT

The walls of the plunger (piston) of the fuel metering pump are relatively thin so that, when pressurized, they expand to provide more effective sealing. A plug is then used in the bore of the plunger to reduce its volume. In one embodiment the wall thickness in the portion of the plunger between the valving openings is further reduced to increase the wall expansion, and thus sealing, adjacent the valving openings. In some embodiments, ends of the members about the plunger are provided with skirts to decrease their tendency to expand, thus improving the sealing.

20 Claims, 5 Drawing Figures

SEALING IN FUEL INJECTION PUMPS

RELATED APPLICATION

This is a continuation of application Ser. No. 558,639, filed Mar. 17, 1975, now abandoned.

BACKGROUND AND SUMMARY OF THE INVENTION

High speed diesel engines for vehicular service are required to operate efficiently and with low emissions over a wide range of speeds. Also, means are frequently employed to increase the density, and therefore the available mass, of oxygen in the cylinder to increase the power output of the engine with minimum increase of engine size and weight. The combined effect is to require the fuel pump to deliver a wide range of quantities of fuel per stroke as well as over a large range of operating speeds. Since the resistance to flow of a fluid through the orifice of injection system nozzles varies as the square of the flow rate, delivery pressures up to 15,000 psi are frequently required if delivery periods are to be short at high speed and spray atomization adequate at starting and low idle speeds.

One of the means employed to determine and modulate the length of the part of the stroke of a fuel pump plunger during which the fuel is delivered at high pressure to an internal combustion engine is a sleeve member on the plunger. This sleeve is separate from the fixed cylinder in which pumping occurs. Both the sleeve and the fixed cylinder are subjected to high pressure within their precision bores during injection. Such pressure causes the bores to enlarge sufficiently to significantly increase the clearance around the plunger. Fuel under pressure flows through this clearance as leakage. Such leakage is unwanted as it reduces to an unacceptable degree the quantity and rate of fuel delivery to the engine at high loads and speeds.

The reciprocating pump plunger, its fixed mating cylinder or barrel, and metering sleeve are conventionally made of high strength steel with very accurately produced, smoothly finished and very hard mating cylindrical surfaces. They are fitted as closely as precision commercial grinding and lapping operations make feasible. Out-of-round, taper, straightness, and surface roughness are all closely controlled on each piece and then they are sorted for size and selectively assembled. The working clearances of the parts are thus held at the minimum achievable by feasible manufacturing techniques.

Although injection pumps incorporating sleeves for metering have demonstrated advantages in ease of control and in low production costs, so far their use has largely been limited to engines having only modest peak injection pressure requirements; i.e., less than 10,000 psi.

In general, the invention relates to fuel injection pumps for internal combustion engines and more particularly to pumps capable of delivering liquid fuels at high pressures as required for most efficient and clean combustion of supercharged diesel engines of the compact, high speed type used to power vehicles. This invention is also particularly applicable to reciprocating plunger fuel injection pumps employing a separately movable sleeve for metering and/or timing control. Leakage of fuel from the high pressure pumping circuit of such pumps is substantially reduced by employing either individually, or in combination, means to add restraint to change in diameter of parts in an unusually effective way or to provide means for enlargement of the pump plunger sufficiently to match enlargement of the bore in which it works. Since working pressures are of a magnitude that is a significant fraction of the fatigue stress limit of heat treated high strength steel, proportions of the components of this invention are such as to avoid the over stressing of them.

One objective is to provide restraint against enlargement of the bore of a cylinder subjected to internal pressures by axially extending its relatively thick wall beyond the portion of it subjected to internal pressure to provide a non-pressurized contiguous structure.

Furthermore, wherever possible, such by-pass means as may be required, which is caused to be closed by plunger motion at start of the fuel delivery cycle, is in the well-known form of a single port in the barrel wall positioned to be closed by the end of the plunger so that pressure in the cylinder acts to press the plunger against the cylinder wall around said port and thus minimize leakage.

Since the foregoing means to minimize leakage is not effective within the sleeve but instead pressure in the system pushes the sleeve away from the port, another objective of this invention is to provide a plunger with a wall of sufficient thinness that it will be enlarged by the injection pressure within it in the area extending outside of the sleeve and fixed cylinder sealing sections, but such plunger wall still of sufficient thickness to enlarge with it that portion of the plunger still within the sealing areas sufficiently to cause a net enlargement of the plunger essentially equal to that of both the sleeve and the fixed cylinder. By these means the actual working clearance will be as slight when working at pressures up to 15,000 psi as at low or zero pressure.

A further objective is to accomplish the above with peak cycle stresses at acceptable levels for essentially infinite fatigue life and to do so with a construction that will be easily made at lower costs than other sleeve metering designs, and in all other aspects be equivalent or superior to those made according to known art and practices.

Sleeve metering pumps are prone to certain unique problems of control and governing as the result of uneven (and sometimes even) transmission of oscillating forces to their controlling mechanism which may resonate or otherwise improperly react to them. These oscillating forces originate from drag of the plungers within the sleeves. As a practical matter, not all plungers and sleeves can be manufactured to have identical fit and finish. The more closely the pair are fitted, the more apparent variations become. If as a result of an adverse combination of tolerances, a sleeve fits too closely, the reciprocating motion of that plunger will produce excessive oscillating forces on its sleeve which through its positioning lever then act on the governor or control mechanism. An object of this invention, then, is to reduce the necessity for excessively close fit of sleeves and plungers as assembled but provide an adequate control of clearance for leakage control by other means. Thus governing and control problems can be alleviated.

DESCRIPTION OF SPECIFIC EMBODIMENTS

The following disclosure is offered for public dissemination in return for the grant of a patent. Although it is detailed to ensure adequacy and aid understanding, this is not intended to prejudice that purpose of a patent which is to cover each new inventive concept therein no matter how others may later disguise it by variations in form or additions or further improvements.

Figure 1:
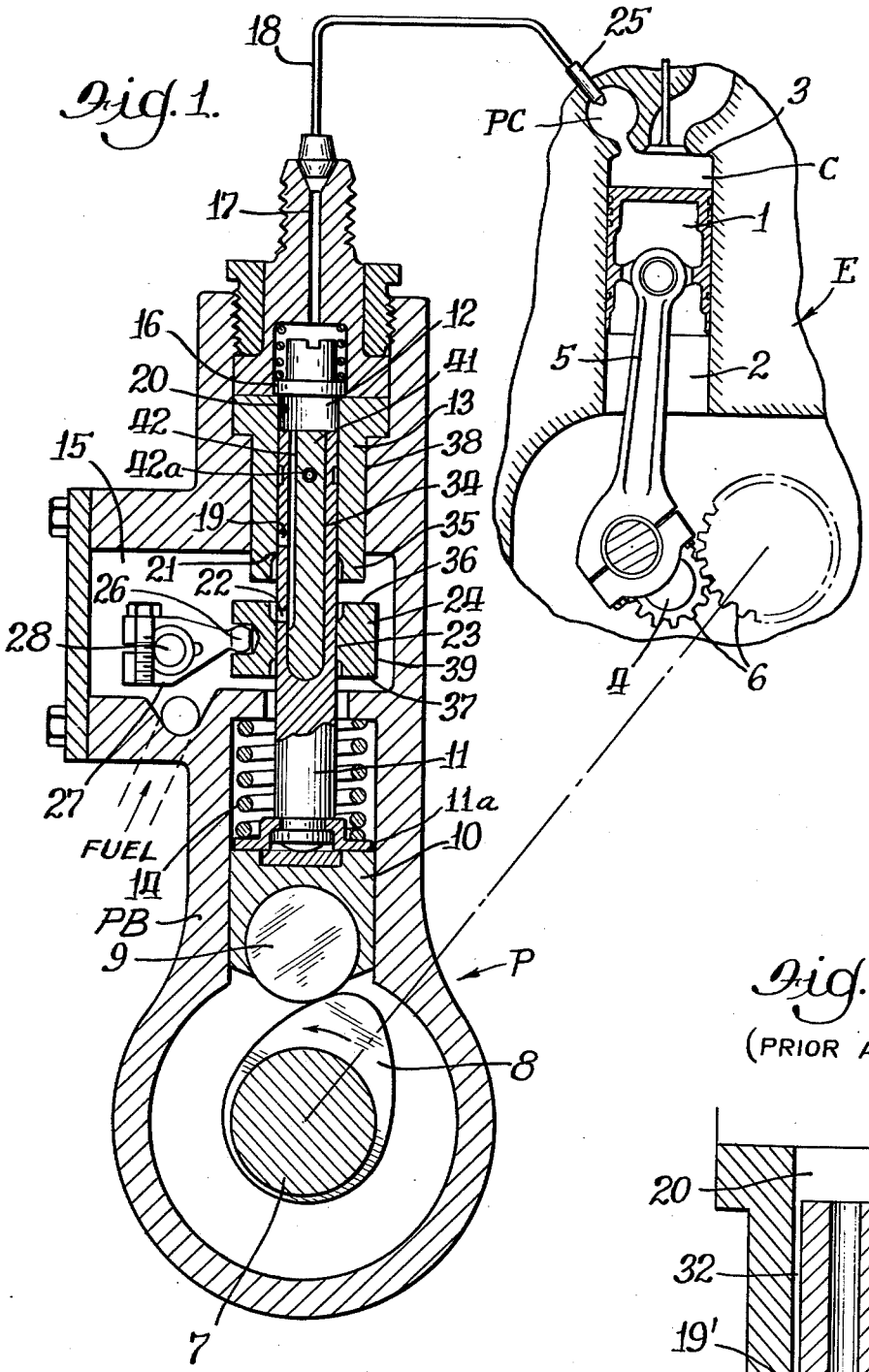
FIG. 1 shows a cross-section of a complete fuel injection pump and indicates schematically its connection to the rest of an internal combustion engine system.

FIG. 1 is a partially schematic representation of internal combustion engine with its accessory fuel injection system including a fuel pump embodying one form of this invention. Engine E includes a piston 1 in a conventional arrangement. The piston reciprocates in cylinder 2 forming with head 3 a combustion chamber C, and in some types of diesel engines, a precombustion chamber PC. The piston is connected to a crankshaft 4 by a connecting rod 5. A set of gears 6 driven by the crankshaft cause the camshaft 7 of the fuel injection pump P to rotate in an appropriate manner relative to the engine.

As is also well known, camshaft 7 has a cam 8 which engages a roller 9 in lifter 10 to cause plunger or piston 11 to displace fuel out of pump space 12 which is a part of the cylinder chamber within fixed cylinder member 13. Spring 14 in compression between the body of pump P and a ring 11*a* on plunger 11 provides the force to hold the plunger against the lifter and the roller against the cam. This then causes the plunger to move in the direction, opposite to that in which it is moved by cam 8, later in the engine cycle when fuel flows into the pump space 12 from supply space 15 within the pump body PB. In the fuel supply space 15 the pressure is relatively low as compared to that employed in injecting fuel into the engine E. In the particular type of injection pump shown, the high pressure required to cause fuel to be pumped out of the pump space past check valve 16 and into the pump bonnet bore 17 and thence through fuel line 18, starts when the plunger advances far enough to cause inlet port 19 in plunger 11 to be closed by entering the precision lapped cylindrical bore or chamber 20 of the fixed cylinder member 13 at its lower end 21. At the same time by-pass port 22 in plunger 11 must be covered by being inside the precision lapped cylindrical bore 23 of metering sleeve 24 in order to close off outlets from the pump space 12 other than through said check valve 16 and the line to fuel nozzle 25.

The metering sleeve 24 is movable on the plunger relative to the fixed cylinder member 13. It is controlled by the ball end 26 of a lever 27 carried on control shaft 28. If the shaft and lever are so turned as to position the sleeve 24 near the bottom end of its range of travel, as is shown in FIG. 1, the by-pass port 22 will emerge from the sleeve bore 23 and thus be opened before the inlet port 19 has been closed by movement into the fixed cylinder. This is the cut-off position and no fuel is pumped into the engine. If the control shaft and lever are turned to position the metering sleeve nearer the fixed cylinder member 13, both ports will be simultaneously closed for some length of the stroke of plunger 11, such stroke length being directly controlled by the position of the sleeve 24 in a manner used for many years.

Figure 2:
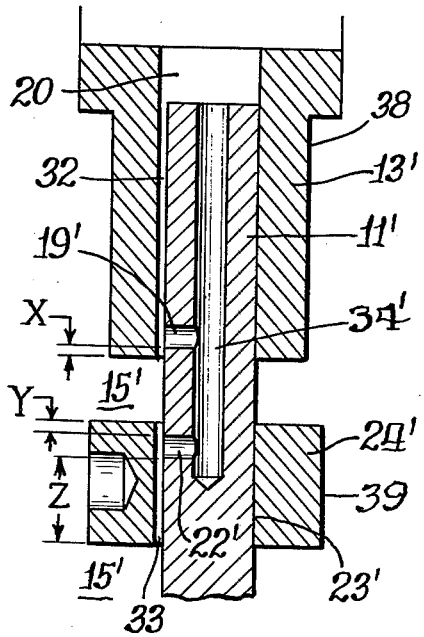
Fig. 2. (PRIOR ART)
FIG. 2 shows a prior art pump plunger fixed cylinder and metering sleeve with working clearances exaggerated to illustrate a major deficiency.

FIG. 2 shows the prior art apparatus. Here the sleeve is in position to cause the by-pass ports 22' and inlet port 19' to be closed simultaneously for a part of the stroke of the plunger. The sleeve 24', fixed cylinder member 13' and plunger 11', as shown in this FIG., are of conventional configuration. The internal bore of the plunger is designated 34'. The clearances 32 and 33 between the plunger and mating internal bores are shown exaggerated in size so that the relative position of these parts when pressure is developed within the pump space can be seen. If the port arrangement in the plunger is unsymmetrical, as here shown, the plunger will tend to be forced toward the cylinder wall opposite the port area as the pressure on the back side will be nearer that of the supply space than on the outer side where the port provides good access to full delivery pressure.

This effect in itself, however, would not be serious if the clearance between the plunger and both cylinder and sleeve remained as slight as when unpressurized. Such parts are made by the best precision methods available and quite commonly are assembled with less than 0.0001 inch total diametrical clearance between the plunger and both the cylinders and the sleeve in the port control portions of their lengths. The most suitable material from which such parts can be made is alloyed steel of near maximum hardness, but unfortunately such steel does stretch when subjected to tensile forces and compress when under pressure. Since the walls of all three of these parts are quite thick relative to their bores, the material at their internal surface is more highly stressed than that at their outer surfaces when they are subjected to an internal pressure higher than that externally thereof.

Even though it is thick walled, an internal pressure of 1000 atmospheres (14,700 psi) along the full length of the fixed cylinder will cause its bore to enlarge 0.0004 (for a 0.4 inch inner diameter and 0.8 inch outer diameter). This added to the initial clearance results in an axial leakage flow area from inlet port 19' equal to an orifice 0.020 inch in diameter. Since the sleeve adds two more end leakage paths, the total leakage area may exceed the area of all the orifices in the nozzle if pressures of this magnitude are required for acceptable engine performance.

It usually is not feasible to increase the outer diameters 38 and 39 of the cylinder member 13' and of the sleeve 24' significantly. To make them any larger than the diameter of the spring and lifter would add to the length of a multiplunger in-line pump and also to weight and cost. Also, unfortunately, the thicker a cylinder is, the less effective is added diameter in reducing internal expansion. In the example just given, a doubling of wall thickness would have reduced bore enlargement by only 21%. Use of two or more ports equally spaced around the plunger will result in more leakage rather than less by shortening the average flow path and increasing the average pressure within the cylinder or sleeve.

The construction shown in FIG. 2 has less leakage than the maximum indicated by the foregoing example. The boundary layer area is very large compared to that of one or just a few orifices so the coefficient of discharge is lower. Also, the pressure within the cylinders is not uniform but diminishes essentially to supply space pressure at the end of the precision fit portion. The cylinder walls are thus subjected to axial bending stresses as well as to hoop stresses. Since, as shown in FIG. 2, the axial lengths X, Y and Z, indicate the length of the fixed cylinder and sleeve, respectively, through which internal pressure falls from maximum to that of the supply space, X and Y are both very short compared to the thickness of the cylinder wall subjected to bending. As a result the inner diameter of the end of the cylinder and sleeve adjacent the ports is essentially that of the cylinder at the ports.

Figure 3:
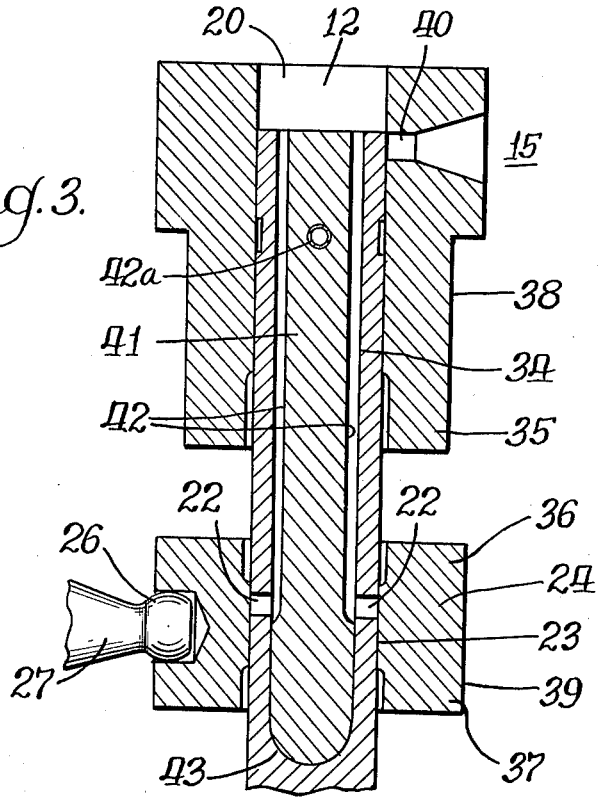
FIG. 3 is of a preferred form of this invention.
Figure 4:
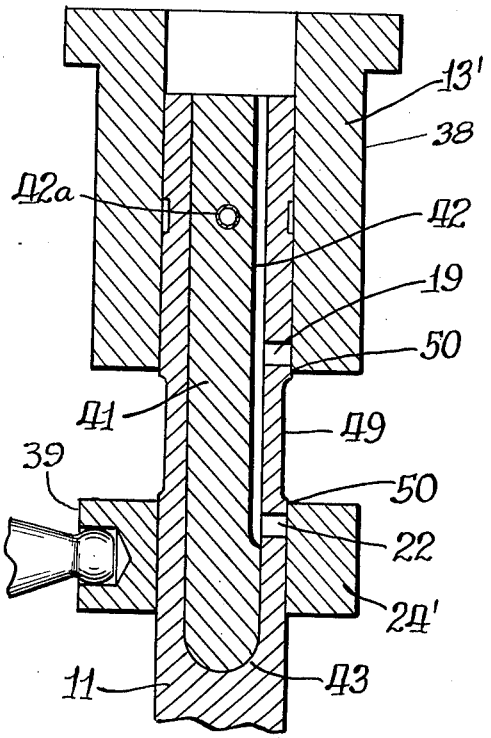
FIG. 4 is of an alternative construction for use on systems that do not require as high injection pressure capability as possible with the preferred construction.
Figure 5:
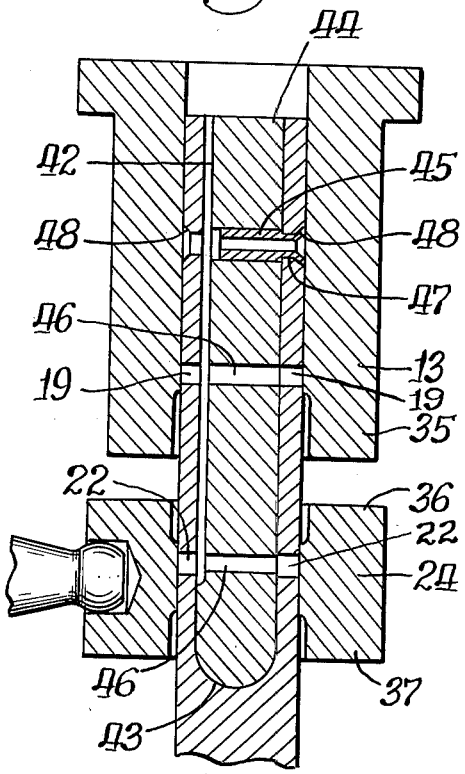
FIG. 5 is another alternative providing balanced pressures on the plunger within the fixed cylinder.

This limitation is corrected by this invention as shown in FIG. 1 and in alternate constructions in FIGS. 3, 4 and 5. Since the fixed cylinder member 13 and sleeve 24 expand during the fuel delivery cycle, the clearance growth could be reduced if the plunger 11 also expanded. The section of the plunger operating in the supply space between the sleeve and cylinder is subjected to the same maximum pressure differential as the cylinder. Therefore, if the bore 34' of the conventional plunger is increased in diameter to the enlarged bore 34, the plunger walls will be thin enough to stretch sufficiently to result in a plunger outer diameter equal to the cylinder end inner diameter.

If end effects are ignored, the equations for strain in thick walled cylinders are:

(1) For fixed cylinder member 13:

$$\Delta d_{2c} = \frac{d_2 p_2}{E}\left[\frac{\left[\frac{d_3}{d_2}\right]^2 + 1}{\left[\frac{d_3}{d_2}\right]^2 - 1} + \mu\right]$$

(2) For plunger 11:

$$\Delta d_{2p} = \frac{2 d_2 P_1}{E\left[\left[\frac{d_2}{d_1}\right]^2 - 1\right]}$$

(3) Equating $\Delta d_{2c} = \Delta d_{2p}$ and assuming $P_1 = P_2$:

$$d_1 = \frac{d_2}{\sqrt{\frac{2}{\left[\frac{(d_3^2 + d_2^2)}{(d_3^2 - d_2^2)} + \mu\right]} + 1}}$$

Where:

$d_1$ = Inner diameter of plunger (I.D.)
$d_2$ = Inner diameter of fixed cylinder and outer diameter of plunger
$\Delta d_2$ = Diameter change at $d_2$
$d_3$ = Outer diameter of fixed cylinder (O.D.)
$p_1$ = Pressure inside plunger
$p_2$ = Pressure inside fixed cylinder
$\mu$ = Poisson's ratio
$E$ = Youngs Modulus of Elasticity If used consistently throughout, radius dimensions can be substituted for diametric dimensions in the foregoing.

The wall of the plunger must be thick enough to avoid over stress when subjected to high internal pressures and for stiffness needed during manufacturing operations. If the wall thickness is less than the radius of the hole in the plunger, internal pressure will cause insignificant enlargement of the plunger. On the other hand if the wall is much thinner than one-half the inner radius of the plunger, wall stresses become excessive. Therefore, the inner diameter should fall in the narrow range of:

$d_1$ equal or greater than $d_2/2$; i.e., $\geqq 0.5 d_2$ $d_1$ equal or less than $d_2/\sqrt{2}$; i.e., $\leqq 0.7 d_2$ The enlargement of the hole in the plunger could result in excessive clearance volume in the pump chamber at the end of the pumping stroke. Air or gas in the system would not be as thoroughly cleared and filling adversely affected. Since a large passage is not needed for flow through the plunger a loose fitting plug 41 of a suitable material (e.g., steel) can be inserted having a flat or flats 42 which leave passageways to accommodate fuel flow. A pin 42a, such as a roll pin, pressed into the plug, but fitting without interference in the plunger, serves to hold the plug in place. The bottom end of the plunger hole 43 should be finished with a generously sized radius to avoid stress concentration and the plug shaped to conform. Since the plug 41 fits loosely it does not affect the foregoing calculations for the diameter of the bore 34 in the plunger.

Since for acceptable stresses operating at very high pressure the plunger cannot safely be proportioned to expand enough to match the expansion of the bore of a cylinder or sleeve of conventional design, the alternative is to keep the cylinder member and sleeve from expanding so much. My invention accomplishes this by adding length extensions or skirts 35 to the end of the cylinder in the supply space and extensions or skirts 36 and 37 to each end of the metering sleeve. These extensions have inside cylindrical bores just enough larger than the plunger outer diameter to assure full flow to and from the inlet and by-pass ports. These extensions are thus subjected only to supply pressure on all sides. Since they are integral but axially displaced from the portions of these cylindrical parts subjected to high pressure differential, they will restrain the enlargement in the intermediate portion which is the location of the end of the precision cylinder where close operating clearances are required.

To be adequately effective the extension or skirt on the fixed sleeve should have an axial length equal or up to 50% greater than the radius of its bore. The combined axial lengths of the extensions or skirts on the sleeve should be equal to or up to 50% greater than the axial length of its precision bore subject to injection pressure. The proper lengths of such extensions which will be effective to control leakage without being so tight as to result in scuffing or seizure, while generally within these ranges, is dependent also on materials used, surface finish of mating parts, fuels to be pumped, and maximum injection pressure to be produced.

FIG. 3 also shows an alternate, and preferred construction if the fuel and pump material combination will tolerate side thrust adjacent the inlet port 40 which communicates with supply space 15. A pair of by-pass ports 22 are shown to reduce drag forces on the metering sleeve 24. This sleeve can be fitted to the plunger with slightly more clearance under unpressurized conditions when shaped according to this invention, since it will not enlarge excessively under pressure. If the sleeve is tightly fitted, the reciprocating motion of the plunger tries to oscillate the sleeve also. By avoiding need for so tight a fit at atmospheric pressure operating and control forces on the sleeve and its control mechanism can be substantially reduced with significant benefits to ease of control.

FIG. 4 shows a configuration of this invention employing a plunger with an enlarged bore and plug and a barrel with outer diameter $d_3$ at least two times plunger diameter $d_2$. The inner plunger diameter would be at the high end of the range specified earlier, i.e., $d_{1a} \sim d_2 1 \sqrt{2}$ The fixed cylinder member 13' and metering sleeve 24' do not have extensions. However, the plunger is modified so that its outer diameter is reduced in section 49 between the inlet and by-pass port as much as fatigue stress limitations of the application make safe. This arrangement will provide improved sealing in applications that do not require pressures as high as the previous embodiments can withstand. This section 49 extends almost up to ports 19 and 22 but leaves a sealing portion 50 at each end adjacent the ports. This sealing portion should have an axial length of at least one-half of the port diameter. The thinner plunger wall at 49 which is in the supply space will, when pressurized, result in increased plunger enlargement in the part of the plunger immediately adjacent 49 (e.g., portions 50) over other designs without making the walls of the precision finished sections too thin for satisfactory manufacturing operations and acceptable stresses at moderate peak injection pressures.

FIG. 5 shows an alternate configuration of the plunger, the plug in the bore of the plunger and their attachment. A plug 44 with a single flat 42 and cross holes 46 will be less costly than one with two flats and still will provide adequate flow connections to balancing pairs of ports. A stepped hollow pin 45 overall short enough to enter the plunger bore is used. After the plug is positioned in the plunger, the pin is moved axially (to the right in FIG. 5) so that its small end 47 projects into the plunger wall. The distal part of that small end is then upset in counterbore 48 to lock the pin in place.

I claim:

1. In a fuel injection pump for an internal combustion engine, which pump comprises a pump body defining a fuel supply space within which is a relatively low fluid pressure, a fixed cylinder member in said body and having a cylinder chamber, a plunger in that cylinder chamber, precision fitted with a close working clearance to the cylinder member and having a portion external to said cylinder member, a sleeve member in said space, separate from said cylinder member and having a cylindrical chamber within which said portion of said plunger is positioned, said sleeve member being similarly fitted on said portion of the plunger, said plunger being formed about an axis and having a concentric axial bore therein, said plunger reciprocating axially with respect to said members, said plunger having porting means arranged to be closed by reciprocation of the plunger relative to the members, the improvement comprising:

said bore in said plunger having a diameter not less than one-half nor more than seven-tenths of the outer diameter of said plunger, whereby pressurization in the bore expands the plunger to reduce the clearance between it and the members.

2. In a fuel injection pump as set forth in claim 1, wherein the plunger has a part of its length positioned between said members and said part of its length has a diameter smaller than that of the adjoining sections of the plunger.

3. In a fuel injection pump as set forth in claim 2, wherein said part of the plunger is spaced a distance axially of the plunger from said porting means, said distance being not less than one-half nor more than the maximum width of said porting means as measured axially of said plunger.

4. In a fuel injection pump as set forth in claim 1, wherein said cylinder member has a skirt concentric with and symmetrical about said plunger, extending axially toward the sleeve member and with a distal end in said space, said skirt having an internal opening through which said plunger extends and of a diameter which is only sufficiently greater than the diameter of the cylinder chamber of the cylinder member than that necessary to provide clearance between the plunger and the skirt and to prevent any pressure build-up of fuel which may flow between the plunger and the cylinder member during operation of the pump whereby the fluid pressure existing between the plunger and the skirt substantially corresponds to said relatively low pressure and said skirt performs most effectively to provide restraint against enlargement of the cylinder member at said one end of the cylinder member.

5. In a fuel injection pump as set forth in claim 1, wherein said sleeve member has two ends and skirts at each of said ends extending axially away from said ends, said skirts of said sleeve member having internal openings through which said plunger extends and of diameters greater than the diameter of the cylindrical chamber of the sleeve member.

6. In a fuel injection pump as set forth in claim 1, wherein the bore in the plunger has a straight cylindrical portion which terminates at a plane perpendicular to the axis of the plunger, said plane when both the plunger and sleeve member are at the position for start of opening of by-pass porting means for end of delivery under highest injection pressure operating conditions, lying adjacent the end of, but outside the length of the cylindrical chamber of the sleeve member, farthest from the cylinder member.

7. In a fuel injection pump for an internal combustion engine, which pump includes a fixed cylinder member having a cylinder chamber open at one end of the member, the fluid pressure existing at said one end of the member being relatively low as compared to the pressure in said chamber during pumping, a plunger precision fitted with close working clearance within that cylinder chamber and extending out of said open end, said member being subjected to high pressure within said cylinder chamber adjacent said end during operation of said pump, the improvement comprising:

said cylinder member having a skirt concentric with and symmetrical about said plunger, said skirt having an internal opening through which said plunger extends and of a diameter which is only sufficiently greater than the diameter of the cylinder chamber of the cylinder member than that necessary to provide clearance between the plunger and the skirt and to prevent any pressure build-up of fuel which may flow between the plunger and the cylinder member during the operation of the pump whereby the fluid pressure existing between the plunger and the skirt substantially corresponds to said relatively low pressure and said skirt performs most effectively to provide restraint against enlargement of the cylinder member at said one end of the cylinder member.

8. In a fuel injection pump as set forth in claim 7, wherein the axial length of the skirt is at least equal to the radius of said cylinder chamber.

9. In a fuel injection pump as set forth in claim 7, wherein the radial thickness of the skirt is at least three quarters the radial thickness of the contiguous part of the cylinder member.

10. In a fuel injection pump as set forth in claim 7, wherein said plunger has a portion external to said cylinder member and including a sleeve member separate from said cylinder member and having a cylindrical chamber within which said portion of said plunger is positioned, said sleeve member being similarly fitted on said portion of the plunger, said plunger being formed about an axis and reciprocating axially with respect to said members, the further improvement comprising:

said sleeve member having two ends and skirts at each of said ends extending axially away from said ends, said skirts of said sleeve member having internal openings through which said plunger extends and of diameters greater than the diameter of the cylindrical chamber of the sleeve member.

11. In a fuel injection pump for an internal combustion engine, which pump includes a pump body defining a fuel supply space within which is a relatively low fluid pressure, a plunger, an annular member about said plunger, said annular member having an internal wall defining an axial internal opening within which the plunger is precision fitted with a close working clearance, said internal wall having an end, said member being subjected to high pressure within said opening adjacent said end during the operation of said pump, the improvement comprising:

said member having a skirt integral therewith, extending beyond said end, being symmetrical about the plunger and coaxial with said opening, said skirt having a distal end in said space and an internal wall at a radial distance from said axis which is only sufficiently greater than is the radial distance of the wall defining said opening than that necessary to provide clearance between the plunger and the skirt and to prevent any pressure build-up of fuel which may flow between the plunger and the cylinder member during operation of the pump whereby the fluid pressure existing between the plunger and the skirt substantially corresponds to said relatively low pressure and said skirt performs most effectively to provide restraint against enlargement of the cylinder member at said one end of the cylinder member.

12. In a fuel injection pump as set forth in claim 11, wherein said annular member is a sleeve with two ends and said opening is cylindrical and extends between said ends, wherein the pump includes a fixed cylinder member with a cylinder chamber, and wherein said plunger has a portion external from said sleeve and extending into said cylinder chamber and being precision fitted with close working clearance to the fixed cylinder member.

13. In a fuel injection pump as set forth in claim 12, wherein the axial length of each skirt of the sleeve member is at least equal to the smaller of (a) the radius of the cylindrical chamber of the sleeve member or (b) one-half the axial length of the cylindrical chamber of the sleeve member.

14. In a fuel injection pump as set forth in claim 12, wherein the radial thickness of each skirt of the sleeve member is at least equal to the greater of (a) three-quarters of the radial thickness of the contiguous part of the sleeve member or (b) one-half the diameter of the plunger.

15. In a fuel injection pump for an internal combustion engine, which pump includes a plunger, an annular member about said plunger, said annular member having an internal wall defining an axial internal opening within which the plunger is precision fitted with a close working clearance, said internal wall having an end, said member being subjected to high pressure within said opening adjacent said end during the operation of said pump, the improvement comprising:

said plunger having an axially concentric bore longer than the part of said plunger lying within the internal opening of the member, said bore being within the member and having a diameter not less than one-half nor more than seven-tenths of the outer diameter of the plunger, whereby said high pressure in the bore expands the plunger to reduce the clearance between it and the member.

16. In a fuel injection pump as set forth in claim 15, wherein the average outer diameter of the members is at least twice the diameter of the internal opening.

17. In a fuel injection pump as set forth in claim 15, including a plug fitted loosely in the bore in the plunger, and means interengaging the plunger and plug to secure the plug axially in place in the bore.

18. In a fuel injection pump as set forth in claim 17, wherein the plug has an axially extending flat along one side of the plug to provide a flow path between the by-pass means of said plunger and the end of the plunger lying within the fixed cylinder member.

19. In a fuel injection pump as set forth in claim 17, wherein the means to secure the plug axially comprises:

said plunger having openings transverse to said axis, said plug having an opening aligned with the plunger openings, and a pin extending through the plug opening and into at least one of the plunger openings, said pin fitting tightly in the plug opening and loosely in the plunger so as to avoid distortion of the precision outer cylindrical surface of the plunger.

20. In a fuel injection pump as set forth in claim 19, wherein one opening in the plunger is larger at the outside of the plunger than it is at the bore of the plunger and is smaller at the bore of the plunger than is the opening in the plug, said pin being stepped to extend through the plug opening and said one plunger opening, the distal end of the pin being upset to be larger than the part of said one opening at the bore of the plunger to hold the pin in place.

* * * * *

UNITED STATES PATENT AND TRADEMARK OFFICE

CERTIFICATE OF CORRECTION

PATENT NO. : 4,082,072

DATED : April 4, 1978

INVENTOR(S) : Lloyd E. Johnson

It is certified that error appears in the above-identified patent and that said Letters Patent are hereby corrected as shown below:

Column 4, line 18, "outer" should read --other--.
Column 5, equation (2), that portion of the equation reading "$2d_2P_1$" should read --$2d_2p_1$--.
Column 5, equation (2), that portion of the equation reading "$-_1$" should read -- $-1$ --.
Column 5, equation (3), that portion of the equation reading "$P_1 = P_2$" should read --$p_1 = p_2$--.
Column 5, equation (3), that portion of the equation reading "$+ 1$" should read -- $+ 1$ --
Column 6, line 10, the formula should read --$d_1$ equal or less than $d_2/\sqrt{2}$; i.e., $\leqq 0.7d_2$--.
Column 6, line 48, "sleeve" should read --cylinder--.
Column 7, line 13, the formula should read --i.e., $d_{1a} \sim d_2/\sqrt{2}$--.
Column 10, line 4, "each" should read --the--.
Column 10, line 10, "each" should read --the--.

Signed and Sealed this

Seventeenth Day of October 1978

[SEAL]

Attest:

RUTH C. MASON
Attesting Officer

DONALD W. BANNER
Commissioner of Patents and Trademarks